US009240650B2

(12) United States Patent
Wu et al.

(10) Patent No.: US 9,240,650 B2
(45) Date of Patent: Jan. 19, 2016

(54) TERMINAL BLOCK ASSEMBLY

(71) Applicant: SWITCHLAB INC., New Taipei (TW)

(72) Inventors: Chih-Yuan Wu, New Taipei (TW); Wei-Chi Chen, New Taipei (TW); Shih-Chung Liu, New Taipei (TW)

(73) Assignees: Switchlab Inc., New Taipei (TW); Switchlab (Shanghai) Co., Ltd., Shanghai (CN)

( * ) Notice: Subject to any disclaimer, the term of this patent is extended or adjusted under 35 U.S.C. 154(b) by 8 days.

(21) Appl. No.: 14/341,963

(22) Filed: Jul. 28, 2014

(65) Prior Publication Data

US 2015/0044897 A1 Feb. 12, 2015

(30) Foreign Application Priority Data

Aug. 7, 2013 (TW) ..... 102128390 A

(51) Int. Cl.
*H01R 13/629* (2006.01)
*H01R 4/48* (2006.01)
*H01R 12/75* (2011.01)

(52) U.S. Cl.
CPC ..... *H01R 13/62933* (2013.01); *H01R 4/48* (2013.01); *H01R 4/4836* (2013.01); *H01R 12/75* (2013.01)

(58) Field of Classification Search
USPC ..... 439/352, 153, 835, 834, 358, 370, 839
See application file for complete search history.

(56) References Cited

U.S. PATENT DOCUMENTS 4,536,726 A * 8/1985 Hideo ..... H01H 71/1027 335/23
4,759,726 A * 7/1988 Naylor ..... H01R 4/5008 439/441
5,588,881 A * 12/1996 Eggert ..... H01R 9/2633 439/709
6,146,217 A * 11/2000 Osada ..... H01R 4/4872 439/441
6,341,989 B1 * 1/2002 Jaag ..... H01R 4/4827 439/725
6,506,071 B2 * 1/2003 Lange ..... H01R 9/26 439/358
6,666,707 B2 * 12/2003 Moret Codina ..... H01R 4/4845 200/51.09
7,625,253 B2 * 12/2009 Eppe ..... H01R 4/4836 439/835
8,062,077 B2 * 11/2011 Hayashi ..... H01R 4/4863 439/725
8,113,858 B1 * 2/2012 Chiang ..... H01R 4/4845 439/188
8,129,641 B2 * 3/2012 Majewski ..... H01R 4/4836 200/335
8,206,164 B2 * 6/2012 Sprenger ..... H01R 9/2625 439/153
8,210,865 B2 * 7/2012 Hayashi ..... H01R 4/4836 439/409
8,262,422 B1 * 9/2012 Chiang ..... H01R 4/4836 439/441
8,475,191 B2 * 7/2013 Schafmeister ..... H01R 4/4836 439/266
2003/0008569 A1 * 1/2003 Matsumoto ..... H01R 4/4827 439/835
2011/0223795 A1 * 9/2011 Schafmeister ..... H01R 4/4836 439/370

* cited by examiner

*Primary Examiner* — Alexander Gilman
(74) *Attorney, Agent, or Firm* — Rosenberg, Klein & Lee

(57) ABSTRACT

A terminal block assembly includes a terminal block and lever member and is less structurally complicated and less likely to deform as compared to the existing terminal block products. The terminal block has a main body and a chamber defined by the main body. The chamber is provided with a metal spring piece, which, in response to movements of the lever member, crimps a leading wire to form electrical connection or release the leading wire. The chamber is also provided with a buckle that performs reciprocating movements and is biased by a spring to normally engage with the lever member. When receiving an operating force, the buckle disengages with the lever member so that the lever member is allowed to move. The terminal block assembly advantageously provides easy and effort-saving operation.

24 Claims, 5 Drawing Sheets

TERMINAL BLOCK ASSEMBLY

BACKGROUND OF THE INVENTION

1. Technical Field

The present invention relates to wire terminal blocks, and more particularly to a terminal block assembly where electrical leading wires are inserted and connected. The inventive terminal block assembly features for a combination of a lever member, a buckle and a metal spring piece that can be operated in an effort-saving manner to crimp or release a leading wire inserted into the terminal block assembly.

2. Description of Related Art

A terminal (block) or a crimp terminal (block) using a metal piece or a metal spring piece covered by an insulating housing (typically made of plastic) to crimp a leading wire inserted therein and thereby form electrical connection is known.

Such a connecting terminal designed be inserted onto a circuit board (such as a PC circuit board) has an insulating housing that is provided with a through hole or an wire inlet, through which a leading wire can be inserted to the interior of the housing. The housing defines therein a chamber for receiving a metal spring piece as described previously, so as to form contact or electrical connection with the leading wire inserted into the housing. The metal spring piece has a head, serving to crimp the leading wire inserted into the housing so as to prevent the leading wire from disconnecting form the metal spring piece or leaving the insulating housing. The established connection between the leading wire and the metal spring piece can be only dismissed when the head is pushed by a tool accessing it from the exterior of the housing.

Basically, the metal spring piece is connected to a terminal pin that is formed symmetrical and narrow, so as to be inserted onto and become electrically conductive with the circuit board.

The prior art also discloses an approach to controlling such a metal spring piece to crimp or release a leading wire by providing a terminal block or a connecting terminal with a lever member. For example, a prior art has proposed a reasonable embodiment, wherein a metal spring piece spans over two sides of a lever member with a forked head, for bearing and responding to operation of the lever member. In other words, when the lever member is operated to press the metal spring piece downward, it forces the tail of the metal spring piece to go downward and engage with a leading wire inserted into the terminal block. When the lever member is operated oppositely, its end pushes the forked head of the metal spring piece in the manner that the tail of metal spring piece raises and the crimped leading wire is now released.

In the foregoing prior art device, for ensuring that the tail of the metal spring piece can firmly secure the leading wire entering the terminal block without the risk of unintentionally disengagement, the forked head of the metal spring piece is provided with a curved segment and a pair of slender arms are extended from the upper portion of the terminal pin corresponding to the curved segment. When the lever member presses the metal spring piece's forked head, the curved segment is pushed toward and get grasped by or engaged with the arms. When the lever member is pushed upward, it drives the curved segment to get away from the arms, so as to dismiss the engagement and release the leading wire.

One issue about such a terminal block or connecting terminal in terms of structural design and application is that for endowing the curved segment with structural strength sufficient for the engagement with the arms of the terminal pin and thus preventing deformation that degrades the engagement between the metal spring piece and the leading wire over time, the curved segment in practice is made as a U-shaped structure. However, the specially processed structure can significantly increase the complexity and cost level for manufacturing the metal spring piece.

Another issue about such a terminal block or connecting terminal in terms of structural design and application is that for ensuring good electrical conductivity, the terminal pin is usually made of a metal material containing cooper (e.g. brass or the like) and thus is less rigid. This makes the terminal pin show inferior structural strength when its arms engage with the curved segment of the metal spring piece. Particularly, after long-term operation, the arms tend to deform and become unreliable for the intended engagement. While this problem may be solved by increasing the thickness or area of the arms, the consequent high complexity and costs are adverse to the relevant manufacturers.

Briefly, the aforementioned references do propose some ideas about the design and combination of connecting terminals/terminal blocks, lever members, metal spring pieces, and terminal pins. It is thus believed that by rearranging and recombining these components, a novel approach superior to the existing devices can be devised to improve the structure, structural strength, utility and thereby applications of a terminal block while minimizing the manufacturing cost and potential deformation.

Apart from overcoming the above-mentioned issues, a preferred terminal block shall satisfy some more expectancies. For instance, with the overall capability and reliability of the crimp and engagement ensured, it is preferred that the operation of the lever member is effort-saving. Also, it is preferred that the structural complexity of the terminal block, the lever member, the metal spring piece and the terminal pin is further improved. These have been neither mentioned nor disclosed in the previously discussed references.

SUMMARY OF THE INVENTION

In view of this, the primary objective of the present invention is to provide a terminal block assembly, which is a combination of a terminal block and a lever member pivotally connected to the terminal block and is less structurally complicated and less likely to deform as compared to the existing terminal block products. The terminal block comprises a main body and a chamber defined by the main body. The chamber receives therein a metal spring piece for in response to the lever member's movement to crimp and electrically connect a leading wire or release the leading wire. A buckle is also installed in chamber such that it is allowed to perform reciprocating movements. The buckle is equipped with a spring that makes the buckle normally engage with the lever member until it receives an operating force that cancel the established engagement. Thereby, the disclosed terminal block assembly is easy and convenient to operate.

According to the present invention, when the lever member has a socket and a retaining portion formed in the socket corresponding to the buckle. When the lever member is operated (pressed downward) to make the metal spring piece crimp a leading wire entering the terminal block, the lever member's retaining portion first pushes the buckle into the socket to engage with the retaining portion, thereby ensuring that the metal spring piece crimps the leading wire firmly.

According to the present invention, the buckle has a pivotal end and a free end. The pivotal end is connected to the main body, so that the buckle's free end is allowed to rock into the lever member's socket to engage with the retaining portion, or rock out when pushed away by the lever member's retaining portion and dismiss the engagement.

According to the present invention, the buckle and the spring are jointly assembled to the main body. The spring has a first end and a second end. The first end abuts against the main body, while the second end abuts against a back of the buckle so as to make the buckle normally stay at a position it engages with the lever member's retaining portion.

DETAILED DESCRIPTION OF THE INVENTION

Figure 1:
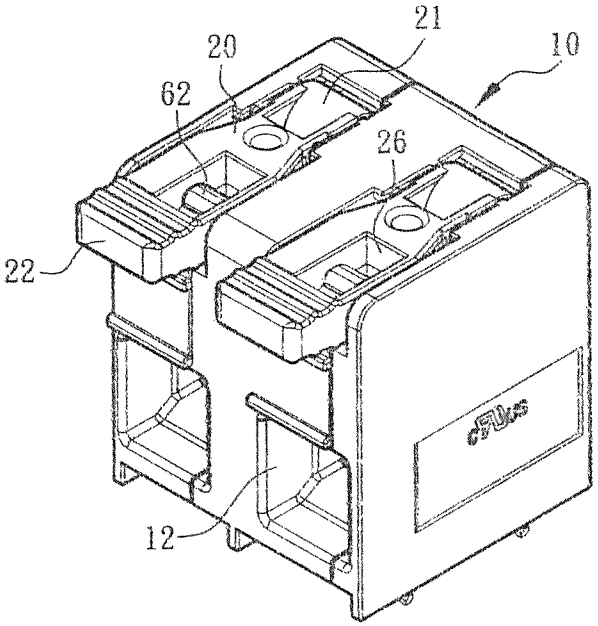
FIG. 1 is a perspective view of a terminal block assembly according to the present invention.
Figure 2:
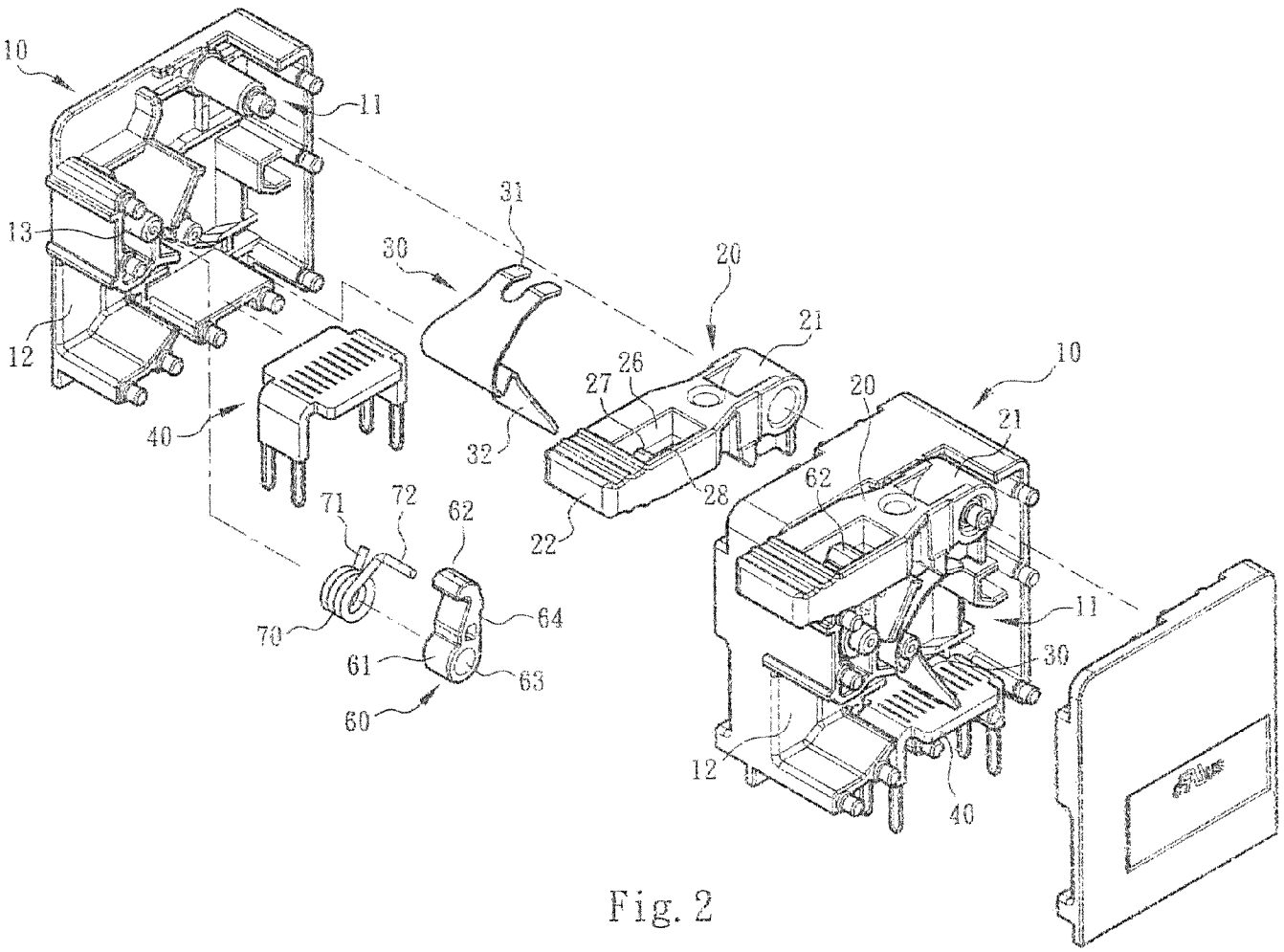
FIG. 2 is an exploded view of the terminal block assembly of FIG. 1, showing its main body, lever member, metal spring piece, buckle and terminal pin particularly.
Figure 3:
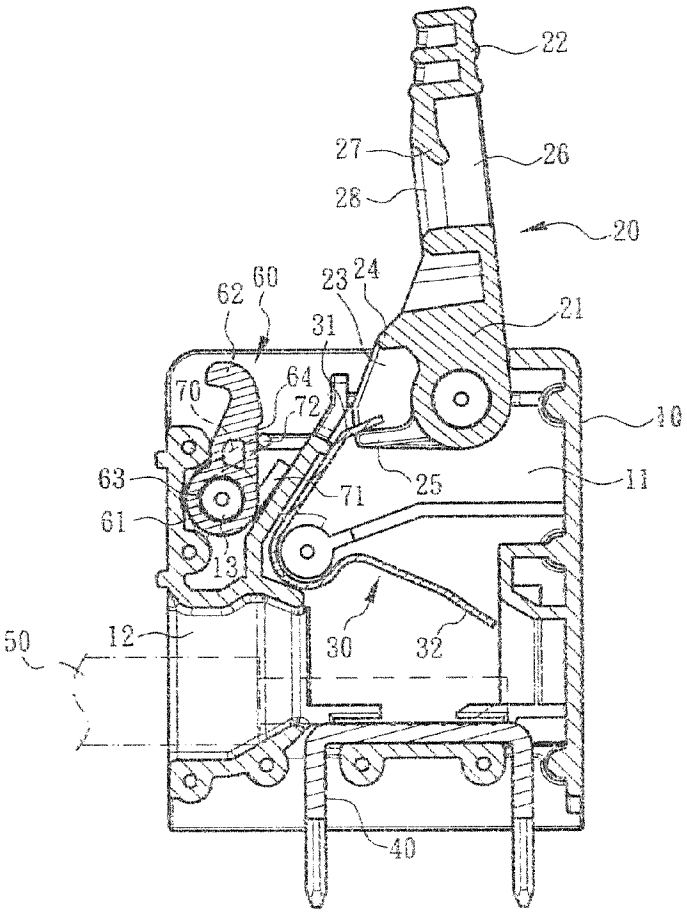
FIG. 3 is a cross-sectional view of the terminal block assembly of the present invention, showing relation between the lift lever member and the metal spring piece.

Referring to FIGS. 1, 2 and 3, according to the present invention, a terminal block assembly comprises a main body made of an insulating material, and a lever member, which are denoted throughout the figures by numerals 10 and 20, respectively. The main body 10 defines therein a chamber 11. The chamber 11 has a metal spring piece 30 and a terminal pin 40 installed therein. The terminal pin 40 is inserted onto a circuit board (e.g. a PUB). The main body 10 also comprises a wire inlet 12 communicated with the chamber 11, so that a leading wire 50 can be inserted into the chamber 11 through the wire inlet 12 and get crimped by the metal spring piece 30, thereby forming electrical connection with the terminal pin 40.

In the illustrated embodiment, the metal spring piece 30 is configured to move in response to the operation of the lever member 20 to crimp and have electrical connection with the leading wire 50, or release the leading wire 50. Particularly, the lever member 20 comprises a pivotal end 21 and an operational end 22. The pivotal end 21 is pivotally connected to the main body 10 or the wall of the chamber 11, so as to enable the operational end 22 to perform reciprocating movements. The pivotal end 21 is provided with a recess 23, and also a pressing portion 24 and a pushing portion 25 that are connected to and jointly define the recess 23.

As shown, the metal spring piece 30 has a head 31 and a tail 32. The head 31 is configured to be received in the recess 23, so that when the pressing portion 24 of the lever member 20 presses the head 31 of the metal spring piece 30 downward, the tail 32 crimps or engages with the leading wire 50 entering the chamber 11, and when the pushing portion 25 pushes the head 31, the tail 32 releases the leading wire 50 from the retained state, as described in detail below.

In a preferred embodiment, in the chamber 11, there is also a buckle 60 that can perform reciprocating movements. The buckle 60 is biased by a spring 70 to normally engage with the lever member 20.

In the illustrated embodiment, a socket 26 and a retaining portion 27 formed in the socket 26 are provided on the lever member 20 between the pivotal end 21 and the operational end 22 or near the operational end 22. The retaining portion 27 defines an inlet 28 for the socket 26. The buckle 60 and the spring 70 are such assembled into the chamber 11 of the main body 10 that they correspond to the socket 26 and the retaining portion 27 of the lever member 20.

FIGS. 2 and 3 depict the buckle 60 as comprising a pivotal end 61 and a free end 62. The pivotal end 61 (including a hole 63 and the spring 70 are combined by a post 13 of the main body chamber 11, so that the free end 62 of the buckle 60 is allowed to rock into the lever member's socket 26 to get engaged with the retaining portion 27, or rock out when pushed away by the retaining portion 27 of the lever member 20 to cancel the foregoing engagement.

In a practicable embodiment, the spring 70 has a first end 71 and a second end 72. The first end 71 abuts against the main body 10, while the second end 72 is a bent portion perpendicularly extending from the spring 70 and abuts against a back 64 of the buckle 60, so as to bias the buckle 60 to normally engage with the lever member's retaining portion 27.

Please refer to FIG. 3, wherein the lever member 20 is lift to an open position. As shown, the pushing portion 25 of the lever member 20 pushes the head 31 of the metal spring piece 30 upward, so as to position the tail 32 as shown in the drawing. At this time, the leading wire 50 cart be inserted into the chamber 11 through the wire inlet 12. When the lever member 20 is pressed down to a close position, or the position as shown in FIG. 4, the pressing portion 24 pressed the head 31 of the metal spring piece 30, and in turn makes the tail 32 to rock downward to a lower position as shown, where it crimps the leading wire 50 entering the main body 10 or the chamber 11.

Figure 4:
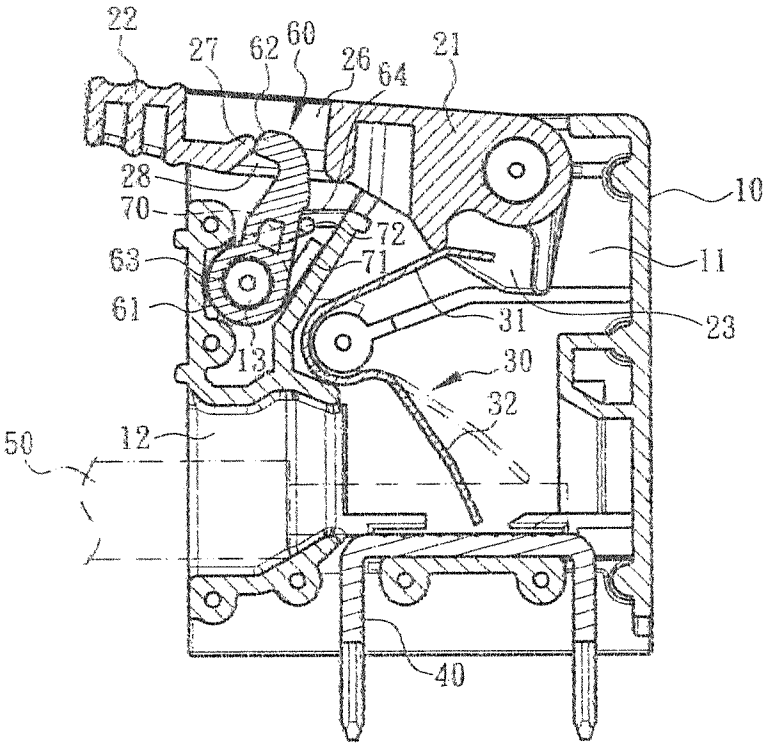
FIG. 4 is a cross-sectional view of the terminal block assembly, showing that the pressed lever member makes the metal spring piece crimp a leading wire and the retaining portion pushes the buckle's free end away.

As shown in FIG. 4, when the retaining portion 27 of the lever member 20 reaches the buckle's free end 62, the retaining portion 27 first pushes the free end 62 of the buckle 60 away, so that the buck 64 of the buckle 60 pushes the spring's second end 72, thereby forcing the spring 70 to deform and accumulate energy.

Figure 5:
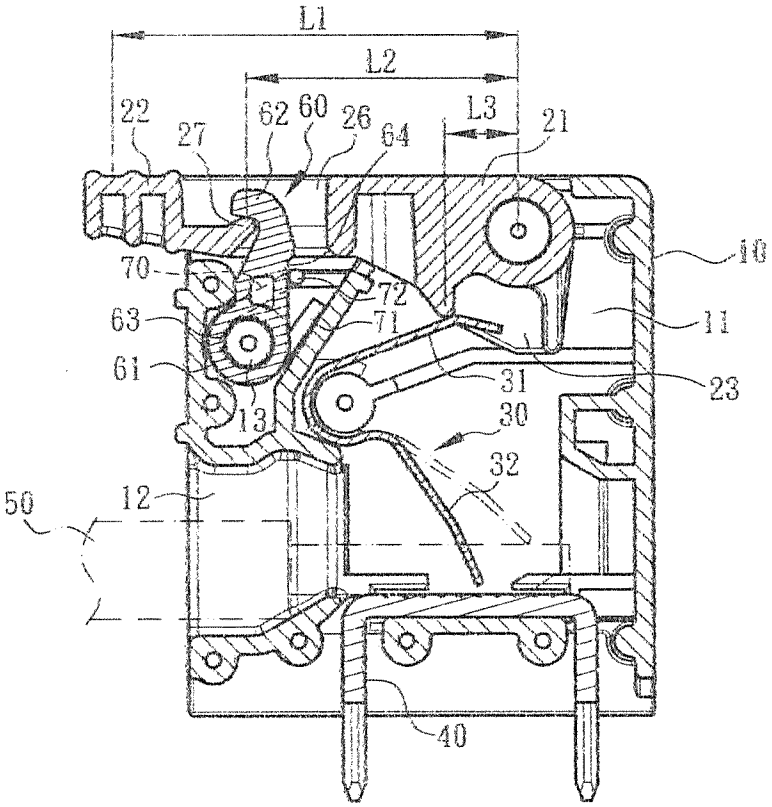
FIG. 5 is a cross-sectional view of the terminal block assembly, showing the engagement between the lever member's retaining portion and the buckle's free end.

Referring to FIG. 5, when the detaining portion 27 passes the buckle's free end 62, the spring 70 releases the energy it accumulates when deforming, and forces the free end 62 to return to the socket 26, where the free end 62 engages with the lever member's retaining portion 27. At this time, the metal spring piece's tail 32 crimps the leading wire 50 firmly.

It is to be understood that when applying an operating force to lift the lever member 20 and make the retaining portion 27 push the free end 62 of the buckle 60 away to dismiss the engagement, a user shall push the lever member 20 toward its open position as shown in FIG. 3, so that the pushing portion 25 pushes the head 31 of the metal spring piece 30 upward, which in turn drives the tail 32 to move upward, thereby freeing the metal spring piece's tail 32 from crimping the leading wire 50 and cancelling the engagement.

Still referring to FIG. 5, it is to be noted that by defining a distance between the lever member's operational end 22 and pivotal end 21 as L1, a distance between the retaining portion 27 or the buckle's free end 62 and the pivotal end 21 as L2, a distance between the pressing portion 24 and the pivotal end 21 as length L3, requirements of the disclosed terminal block assembly can be expressed as: $L1>L2>L3$; and that L1 is approximately equal to $4\times L3$ to $5\times L3$ while L2 is approximately equal to $3\times L3$ to $4\times L3$ (i.e. $3.5\times L3$). Assuming that the force the pressing portion 24 uses to press the metal spring piece's head 31 downward is F, the minimum force the user may use to operate the lever member at its operational end 22 is only 1/5×F.

Figure 6:
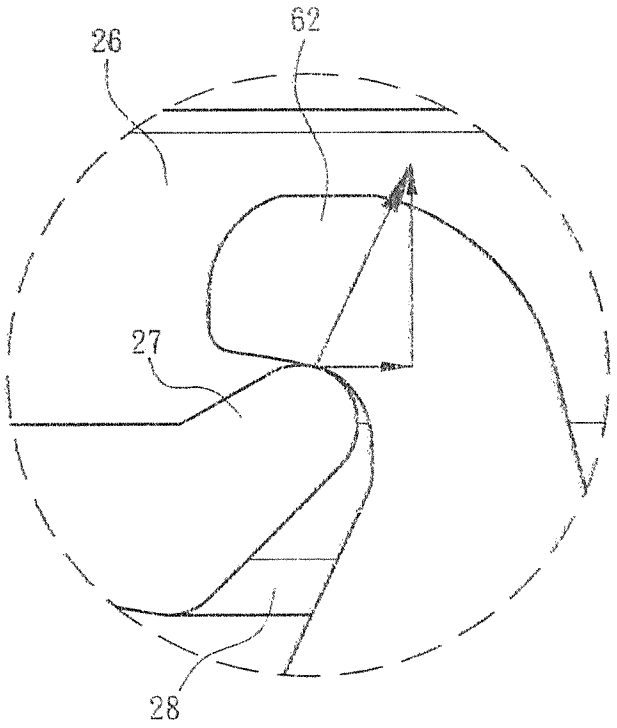
FIG. 6 is a schematic drawing showing the acting force distribution cross the lever members retaining portion and the buckle's free end.

Referring to FIG. 6, since the lever member's retaining portion 27 or the buckle's free end 62 is away from the lever member's pivotal end 21 a distance L2 (namely 3.5×L3), it means that an engaging force or total acting force by which the retaining portion 27 engages with the buckle's free end 62 is 1/3×F to 1/4×F (e.g. 1/3.5×F).

FIG. 6 particularly illustrates that the engaging force or total acting force (1/3.5×F) is composed of a horizontal component and a vertical component. The horizontal component is equal to a half of the engaging force or total acting force, i.e. 1/7×F.

In other words, when lilting the lever member 20 as mentioned previously, the user needs only to exert an operating force of 1/7×F to make the retaining portion 27 push the free end 62 of the buckle 60 toward the right of the drawing and dismiss the engagement. Thus, the operation is easy and effort-saving.

Representatively, in addition to allowing easy and reliable operation, the disclosed terminal block assembly is superior to the existing devices for the following advantages.

First, the terminal and the associated components the lever member 20 having the socket 26 and the retaining portion 27 to work with the free end 62 of the buckle 60; the spring second end 72 abutting against the back 64 of the buckle 60 to make the buckle 60 normally stay at its engaged position; and the arrangement among the lever member 20, the metal spring piece 30 and the buckle 60) have been reconsidered and redesigned in terms of usage and structure, and are different from the conventional schemes. This allows the disclosed terminal block assembly to be more adaptive and applicable. With the overall capability and reliability of the crimp and engagement ensured, the disclosed terminal block assembly has improved structural strength and operational convenience as compared to the prior art.

Second, the disclosed approach eliminates the use of the slender arms on the terminal pin for working with the curved segment of the metal spring piece's head as implemented in the aforementioned prior-art device, thereby being free from the shortcomings about unwanted part deformation, inferior engagement, and high complexity as well as costs for manufacturing.

Third, it is to be noted that in the known approach for making the terminal pin's arms to release the curved segment of the metal spring piece's head they grasp and cancelling an established engagement, a user has to exert a quite large operating force (greater than 1/5×F). As comparison, in the present invention, the retaining portion 27 only needs a force of 1/7×F to push the buckle 60 away and achieve disengagement. Thus, the configuration and combination of the lever member 20, the metal spring piece 30, the buckle 60, and the spring 70 directly contribute to the claimed effort-saving operation.

To further explain, the particular conventional device has the engagement between the curved segment on the metal spring piece's head and the terminal pin's arms realized on an axis perpendicular to the lever member's pivotal end. Assuming that the engaging force between the curved segment and the arms is F (which in practice is usually greater than two times of the aforementioned a user has to exert a force of at least 1/5×F for disengagement, much greater than that required between the lever member's retaining portion 27 and the buckle's free end 62 (namely the horizontal component as discussed above). Thus, the present invention provides great operational convenience. To sum up, the present invention provides an effective terminal block assembly that has novel configuration and possess various advantageous that unseen in the prior art.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. A terminal block assembly, comprising:
- a terminal block, including:
  - a main body,
  - a chamber defined in the main body, and
  - a wire inlet communicated with the chamber; and
- a lever member, having:
  - a pivotal end, being pivotally connected to the main body; and
  - an operational end, being configured to perform reciprocating movements;
- the terminal block assembly being characterized in:
  - the lever member having a pressing portion and a pushing portion both provided at the pivotal end;
  - a metal spring piece being deposited in the chamber and having a head and a tail, wherein the lever member drives the head of the metal spring piece to make the tail to tilt up and down; and
  - a buckle being installed in the chamber, configured to perform reciprocating movements, and being biased by a spring to normally engage with the lever member.

2. The terminal block assembly of claim 1, further comprising a terminal that is located in the chamber to be installed on an external circuit board.

3. The terminal block assembly of claim 2, wherein the wire inlet of the main body allows a leading wire to be inserted into the chamber therethrough and crimped by the tail of the metal spring piece, thereby forming electrical connection with the terminal pin.

4. The terminal block assembly of claim 1, further comprising a recess that is formed on the pivotal end of the lever member and connecting the pressing portion and the pushing portion.

5. The terminal block assembly of claim 4, wherein the head of the metal spring piece is received in the recess, thereby allowing the lever member to have the pressing portion pressing the head of the metal spring piece downward or have the pushing portion pushing the head of the metal spring.

6. The terminal block assembly of claim 1, wherein the lever member has a socket in which a retaining portion is formed so that the retaining portion defines an inlet of the socket.

7. The terminal al block assembly of claim 4, wherein the lever member has a socket in which a retaining portion is formed so that the retaining portion defines an inlet of the socket.

8. The terminal block assembly of claim 6, wherein the socket and the retaining portion of the lever member are located between the pivotal end and the operational end.

9. The terminal block assembly of claim 6, wherein the socket and the retaining portion of the lever member are located near the operational end.

10. The terminal block assembly of claim 1, wherein the buckle has a pivotal end and a free end;
- the pivotal end having a hole, and being assembled to a post provided in the chamber of the main body by the hole together with the spring, so that the free end of the buckle is allowed to perform the reciprocating movements.

11. The terminal block assembly of claim 6, wherein the buckle has a pivotal end and a free end;

the pivotal end having a hole, and being assembled to a post provided in the chamber of the main body by the hole together with the spring, so that the free end of the buckle is allowed to enter the socket of the lever member to have engagement with the retaining portion while performing the reciprocating movements to; and the retaining portion of the lever member being also configured to push the buckle free end away, thereby cancelling the engagement.

12. The terminal block assembly of claim 10, wherein the spring comprises:

a first end, abutting against the main body; and a second end, being a bent portion perpendicularly extending from the spring and abutting against a back of the buckle.

13. The terminal block assembly of claim 11, wherein the spring comprises:

a first end, abutting against the main body; and a second end, being a bent portion perpendicularly extending from the spring and abutting against a back of the buckle.

14. The terminal block assembly of claim 12, wherein when the retaining portion of the lever member reaches the free end of the buckle, the retaining portion first pushes the free end of the buckle away, so that the back of the buckle pushes the second end of the spring, thereby forcing the spring to deform and accumulate energy; and when the retaining portion passes the free end of the buckle, the spring releases the energy accumulated, and positions the free end at where the free end engages with the retaining portion of the lever member.

15. The terminal block assembly of claim 12, wherein the lever member allows the retaining portion to push the free end of the buckle away, and in turn makes the pushing portion push the head of the metal spring piece upward, thereby cancelling the engagement.

16. The terminal block assembly of claim 6, wherein when a distance between the operational end of the lever member and the pivotal end of the lever member is L1, a distance between the retaining portion and the pivotal end of the lever member is L2, and a distance between the pressing portion and the pivotal end of the lever member is L3, L1 is greater than L2 and L2 is greater than L3.

17. The terminal block assembly of claim 16, wherein L1 is to 5 times as large as L3 is, and L2 is 3 to 4 times as large as L3 is.

18. The terminal block assembly of claim 10, wherein when a distance between the operational end of the lever member and the pivotal end of the lever member is L1, a distance between the free end of the buckle and the pivotal end of the lever member is L2, and a distance between the pressing portion and the pivotal end of the lever member is L3, L1 is greater than L2 and L2 is greater than L3.

19. The terminal block assembly of claim 18, wherein the L1 is 4 to 5 times as large as L3 is, and L2 is 3 to 4 times as large as L3 is.

20. The terminal block assembly of claim 17, wherein when a force the pressing portion used to press the head of the metal spring piece down is F, an operating force applied to the operational end of the lever member is one fourth to one fifth as large as F is.

21. The terminal block assembly of claim 19, wherein when a force the pressing portion used to press the head of the metal spring piece down is F, an operating force applied to the operational end of the lever member is one fourth to one fifth as large as F is.

22. The terminal block assembly of claim 17, wherein a total acting force generated by the retaining portion working with the free end of the buckle is one third to one fourth as large as F is.

23. The terminal block assembly of claim 19, wherein a total acting force generated by the retaining portion working with the free end of the buckle is one third to one fourth as large as F is.

24. The terminal block assembly of claim 22, where the total acting force comprises a horizontal component and a vertical component, in which the horizontal component is a half as large as the total acting force is.

* * * * *